US010907407B2

(12) United States Patent
Huang et al.

(10) Patent No.: US 10,907,407 B2
(45) **Date of Patent: *Feb. 2, 2021**

(54) UNEQUAL-TORQUE COIL SPRING AND SPRING MOTOR THEREOF

(71) Applicants: ANLI SPRING CO., LTD., New Taipei (TW); Hsien-Te Huang, Taipei (TW)

(72) Inventors: Hsien-Te Huang, Taipei (TW); Ta-Peng Huang, Taipei (TW)

(73) Assignees: ANLI SPRING CO., LTD., New Taipei (TW); Hsien-Te Huang, Taipei (TW)

( * ) Notice: Subject to any disclaimer, the term of this patent is extended or adjusted under 35 U.S.C. 154(b) by 117 days.

This patent is subject to a terminal disclaimer.

(21) Appl. No.: 16/240,267

(22) Filed: Jan. 4, 2019

(65) Prior Publication Data

US 2019/0136612 A1 May 9, 2019

Related U.S. Application Data

(63) Continuation of application No. 15/439,313, filed on Feb. 22, 2017, now Pat. No. 10,174,547.

(30) Foreign Application Priority Data

Mar. 22, 2016 (TW) ..... 105204038 U

(51) Int. Cl.
*E06B 9/62* (2006.01)
*E06B 9/322* (2006.01)
*B65H 75/48* (2006.01)

(52) U.S. Cl.
CPC ..... *E06B 9/322* (2013.01); *B65H 75/486* (2013.01); *E06B 9/62* (2013.01); *E06B 2009/3222* (2013.01)

(58) Field of Classification Search
CPC ..... E06B 9/62; E06B 9/322; B65H 75/486
See application file for complete search history.

(56) References Cited

U.S. PATENT DOCUMENTS

| | | | |
|---|---|---|---|
| 5,482,100 | A | 1/1996 | Kuhar |
| 6,149,094 | A | 11/2000 | Martin et al. |
| 6,283,192 | B1 | 9/2001 | Toti |
| 6,289,965 | B1 | 9/2001 | Ruggles |

(Continued)

FOREIGN PATENT DOCUMENTS

| | | |
|---|---|---|
| JP | 53113955 | 10/1978 |
| JP | 53115442 | 10/1978 |

OTHER PUBLICATIONS

Petition for Post Grant Review for related U.S. Pat. No. 10,174,547, dated Oct. 8, 2019; 97 pages.

(Continued)

*Primary Examiner* — Sang K Kim
(74) *Attorney, Agent, or Firm* — Procopio, Cory, Hargreaves & Savitch LLP

(57) ABSTRACT

An unequal-torque coil spring and a spring motor thereof which is adapted for a curtain set that can automatically fold back a curtain; the same provides a feedback torque that responds to different stages of a curtain-folding working process and generates various corresponding torque in response, as each of the different stages requires a different force. Consequently, the curtain can be folded back at a steady speed, and positionally fixed at any height when the curtain is lowered.

8 Claims, 13 Drawing Sheets

(56) References Cited

U.S. PATENT DOCUMENTS

| | | | |
|---|---|---|---|
| 6,648,050 | B1 | 11/2003 | Toti |
| 2005/0072635 | A1 | 4/2005 | Toti |
| 2005/0087394 | A1 | 4/2005 | Toti |
| 2008/0185109 | A1 | 8/2008 | Lin |
| 2011/0277943 | A1 | 11/2011 | Lin |

OTHER PUBLICATIONS

Mechanics of Materials textbook published in 1981; 902 pages.
PTAB Decision to Institute PGR dated Apr. 20, 2020 for PGR2020-00001 (U.S. Pat. No. 10,174,547 B2); 54 pages.
Patent Owner Response dated Jul. 17, 2020 for PGR2020-00001 (U.S. Pat. No. 10,174,547 B2); 56 pages.
Patent Owner Motion to Amend dated Jul. 17, 2020 for PGR2020-00001 (U.S. Pat. No. 10,174,547 B2); 33 pages.
Ex. 2019—Certified Priority Document of TW Application No. 105204038 dated Jul. 17, 2020 for PGR2020-00001 (U.S. Pat. No. 10,174,547 B2); 21 pages.
Ex. 2020—Supplemental Declaration of Dr. Glenn Vallee dated Jul. 17, 2020 for PGR2020-00001 (U.S. Pat. No. 10,174,547 B2); 36 pages.
Ex. 2001—Declaration of Dr. Glenn Vallee dated Jan. 22, 2020 for PGR2020-00001 (U.S. Pat. No. 10,174,547 B2); 52 pages.
Patent Owner's Preliminary Response dated Jan. 22, 2020 for PGR2020-00001 (U.S. Pat. No. 10,174,547 B2); 75 pages.
Ex. 2004—Declaration of Hsien-Te Huang dated Jan. 21, 2020 for PGR2020-00001 (U.S. Pat. No. 10,174,547 B2); 5 pages.
Ex. 2008—Engineering Drawings by Tsai & Wang with verified translation dated Jan. 21, 2020 for PGR2020-00001 (U.S. Pat. No. 10,174,547 B2); 1 pages.
Petitioner Opposition to Motion to Amend filed Oct. 9, 2020; 16 pages.
Petitioner Reply to Patent Owner Response filed Oct. 9, 2020; 22 pages.
Ex. 1016 filed by Petitioner on Oct. 9, 2020 (Supplemental Expert Declaration of Zhang); 25 pages.
PTAB Preliminary Guidance filed Oct. 30, 2020; 11 pages.
Patent Owner Revised Motion to Amend filed Nov. 20, 2020; 36 pages.
Patent Owner Sur-Reply filed Nov. 20, 2020; 25 pages.
Ex. 2021 filed by Patent owner Nov. 20, 2020 (Supplemental Expert Declaration of Vallee); 23 pages.
Ex. 2022 filed by Patent owner Nov. 20, 2020 (website evidence from Engineering Toolbox); 3 pages.
Ex. 2023 filed by Patent owner Nov. 20, 2020 (website evidence from Aplustopper); 16 pages.

UNEQUAL-TORQUE COIL SPRING AND SPRING MOTOR THEREOF

CROSS-REFERENCE TO RELATED PATENT APPLICATION

This application is a continuation of U.S. patent application Ser. No. 15/439,313 filed Feb. 22, 2017, and titled "Unequal-torque coil spring and a spring motor thereof," which claims the benefit of Taiwan Patent Application No. 105204038 filed Mar. 22, 2016. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an unequal-torque coil spring and a spring motor thereof, and more particularly to an unequal-torque coil spring that is applied to a curtain set which can automatically fold a curtain and used to provide a feedback torque thereto, thereby achieving objective of providing a feedback force corresponding to an actual requirement from different stages of a curtain-folding working process.

BACKGROUND OF THE DISCLOSURE

For the purpose of safely using curtains, designs of curtain sets without exposed pull cords have been tirelessly developed in the industry. As shown in FIG. 1, a curtain set 1 uses a spring motor 2 to produce a feedback force; after a lower beam 14 is pulled downwards and becomes lowered, a downward pulling force from a pull cord 12 is transmitted and stored in an equal-torque coil spring 20 inside of a spring motor 2 via a first reel drum 21 and a second reel drum 22. When a curtain 15 is folded back, the force stored in the spring motor 2 can be fed back and output to the lower beam 14, so that a safe design in which the curtain 15 can be folded back by a self-generated force without a pull cord may be applied.

Further, the spring motor 2 employs an elastic reaction force of approximately equal torque from a strip of equal-torque coil spring 20 to drive the first reel drum 21 and the second reel drum 22 at two sides, so as to reversely reel back the pull cord 12 at both sides and pull up the lower beam 14 by using the force stored in the equal-torque coil spring 20, thereby achieving the objective of folding back the curtain 15. To lower the curtain 15, a user pulls the lower beam 14 downwards, and an action force is transmitted to the first reel drum 21 and the second reel drum 22 via the linkage of the pull cord 12 and the turning of a turning component 13, and then the force is reversely output to the equal-torque coil spring 20 for storage via the first reel drum 21 and the second reel drum 22, so that the force can be used to fold back the curtain 15 later.

The equal-torque coil spring 20 is of a spiral shape, and generates an effective torque curve that is close to being horizontal, which is difficult to match the gravity force of unequal masses accumulated from setting the curtain 15 to different heights. Therefore, it is often necessary to add weights that are hung from the curtain and repeatedly adjust a torque value of a single curtain set 1 during production, in order to achieve a steady folding speed.

Referring to FIGS. 2 and 3, the spring motor 2 includes a housing 201 assembled and provided with an axle 23 being combined with a chainring 230, and a coiling axle 24 being combined with a linking chainring 240; the chainring 230 and the linking chainring 240 are engaged with each other, and have the first reel drum 21 and the second reel drum 22 pivoted and disposed longitudinally at a front end and a rear end, respectively; the first reel drum 21 and the second reel drum 22 are respectively provided with a first chainring 210 and a second chainring 220, which are respectively engaged with the chainring 230 and the linking chainring 240. A detachable bearing 231 is sleeved outside of a cylindrical surface of the axle 23, and a cylindrical surface of the detachable bearing 231 allows a spiral inner circle of the equal-torque coil spring 20 to sleeve on; a release end of the equal-torque coil spring 20 is a joining end 200 which is joined to a radial cylindrical surface of the coiling axle 24.

Referring back to FIG. 1, when the lower beam 14 is pulled downwards, the generated force is released from the axle 23 to the coiling axle 24 as the equal-torque coil spring 20 is coiled around by the coiling axle 24, and the affected equal-torque coil spring 20 will generate a recovery coiling force (feedback force), when the lower beam 14 is pushed upwards, the feedback force from the equal-torque coil spring 20 is activated and released to reverse the equal-torque coil spring 20 back to the position of the axle 23. The reverse process happens as follows: the linking chainring 240 of the coiling axle 24 drives the second reel drum 22 via the second chainring 220 and then drives the first reel drum 21 via the chainring 230, so that the pull cord 12 at both sides are reeled back by linking the first reel drum 21 and the second reel drum 22.

In the aforesaid process, a coiling speed of the equal-torque coil spring 20 is different from that of the chainring 230 due to the presence of the detachable bearing 231, the chainring 230 solely serves the purpose of shifting the force in this case, and shifts a force resulted from the first reel drum 21 being pulled by the pull cord 12 and transfers the force to the linking chainring 240 of the coiling axle 24. Similarly, when the second reel drum 22 at the right is pulled by the pull cord 12, the second chainring 220 can also transfer the force to the coiling axle 24, so that the coiling axle 24 can pull and coil the equal-torque coil spring 20, and the equal-torque coil spring 20 sequentially releases the force and turns around a center of a diameter thereof when it is pulled and coiled around by the coiling axle 24.

Referring to FIG. 4, which shows the curtain 15 that has been folded upwards completely. When the disposed lower beam 14 is pulled by the pull cord 12 and moved upwards, each curtain piece 150 is sequentially accumulated on an upper surface of the lower beam 14; consequently, a plurality of curtain pieces 150 are accumulated and form a total mass W of the stacked curtain pieces, which results in a maximum pulling force from the pull cord 12 at this moment. In comparison, the pull cord 12 also withstands the maximum pulling force at this moment, and holds the lower beam 14 to keep it from falling downwards.

When the curtain piece 15 is completely lowered, the lower beam 14 is at a lowest position which is a fifth height H5, and the pulling force withstood by the pull cord 12 is the minimum at this moment as it only needs to support the mass of the lower beam 14 now. Therefore, within the range of a total lift height H0, as the lower beam 14 has the curtain pieces 150 accumulated on top of it one by one from the bottom, the weight load of the curtain pieces 150 gradually increases as a result, and the weight load reaches maximum when the lower beam 14 reaches the top, and becomes minimum when the lower beam 14 is at the bottom.

In addition, when it reaches a third height H3 defined in the curtain folding process, the spring motor 2 needs to produce a balancing pulling force against the lower beam 14 when it is located at the third height H3, so as to prevent the lower beam 14 from falling downwards, while the spring motor 2 also needs to avoid producing excessive pulling force that pulls the lower beam 14 upwards.

When the lower beam 14 is located at the lowest position which is the fifth height H5, and being pulled upwards to a first height H1, an upward momentum is generated from the combined factor between a mass of the lower beam 14 and a pulling speed of the pull cord 12. Therefore, it would be ideal to have the pulling force from the pull cord 12 lessened when the lower beam 14 reaches a second height H2, so as to achieve a buffering effect, and then have the spring motor 2 output a smaller torque again in order to slowly pull up the lower beam 14 located at the second height H2 to the first height H1, so as to prevent the momentum from the lower beam 14 to impact on a lower part of an upper beam 11.

Referring to FIG. 5, two sides of each of the curtain pieces 150 are respectively combined with ladder strings 120 at two sides, and two ladder strings 120 form a top-to-bottom linkage between a pitch P to support the curtain pieces 150. Consequently, each of the curtain pieces 150 are linked from top to bottom, and topmost ends of the ladder strings 120 are combined with the upper beam 11. As shown in the figure, when the lower beam 14 is located at a half-height position Hn, the weight of the total mass W of the stacked curtain pieces is withstood by the upper surface of the lower beam 14; when the pull cord 12 is pulling upwards or supporting the curtain in a fixed position, the ladder strings 120 help support the total weight of all curtain pieces 150 interspaced by the pitch P.

As the lower beam 14 is lowered, the feedback torque stored in the spring motor 2 is needed for fixing the lower beam 14 at the half-height Hn position, while the upper surface of the lower beam 14 is supporting the total mass W of the stacked curtain pieces at Hn at the same time. Thus as the lower beam 14 moves upwards, greater balancing torque is needed from the spring motor 2. In contrast, as the lower beam 14 moves downwards, the torque needed from the spring motor 2 declines proportionately. Subsequently, the required working torque curve from the spring motor 2 turns from steep to flat.

To allow the spring motor 2 of the curtain set 1 to produce the torque needed for folding back the curtain 15 during the curtain folding process, as disclosed in U.S. Pat. No. 6,283,192 B1; the main technical feature is related to the longitudinal area of a strip of spring, and a method of boring holes to form weak points is utilized to distribute bore holes of unequal sizes and distances, so that the strip of spring can have different elastic actions at a front end and a back end. For producing feedback torque output for actual system requirements based on simulations, and another U.S. Pat. No. 5,482,100, a strip of spring is formed with different thicknesses or widths at a front end and a back end in order to produce elastic reactions that result in varied torque to meet the actual requirements for torque. But the method of boring holes leads to weaknesses in the strip of spring, which results in the problems of mechanical damage and difficulty in processing. Further, because the strip of spring is a very thin metal slice that needs to have different thicknesses and widths at a front end and a rear end, the processing control for making increasing or decreasing thicknesses and widths needs to be extremely precise, which makes the production of the spring difficult and time-consuming.

SUMMARY OF THE DISCLOSURE

A primary objective of the present disclosure is to provide an unequal-torque coil spring and a spring motor thereof, which provides feedback torque from the unequal-torque coil spring in response to requirements for different forces in different stages of a curtain-folding working process; multiple levels of torque are allocated for horizontally folding back a curtain in a curtain set. When the curtain is folded back, the torque is used to meet the requirements for the curtain-folding process and fixing the curtain at any heights when the curtain is lowered. The unequal-torque coil spring is fabricated in separate processes by simple procedures, so as to allow the unequal-torque coil spring to have different torque reactions at multiple sections.

A second objective of the present disclosure is to sequentially make various curvatures in different sections of a reed strip longitudinally, so as to fabricate an unequal-torque coil spring having unequal feedback torque.

A third objective of the present disclosure is to have different curvatures distributed in the unequal-torque coil spring; the curvatures are distributed from one end of the reed strip having a joining end to another end at different levels.

A fourth objective of the present disclosure is to allow the unequal-torque coil spring to generate usable feedback torque values with a ratio between 4/1:1/1.

A fifth objective of the present disclosure is to have the unequal-torque coil spring assembled in a housing of a spring motor, and indirectly drives a first reel drum and a second reel drum disposed at two sides of the spring motor, so that the first reel drum and the second reel drum simultaneously generate corresponding torque for pulling a pull cord coiled thereto.

To enable a further understanding of the said objectives and the technological methods of the invention herein, the brief description of the drawings below is followed by the detailed description of the preferred embodiments.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

The present disclosure provides an unequal-torque coil spring and a spring motor thereof, which uses a simple method for disposing different curvatures in multiple front and rear sections of a reed strip, so as to provide a feedback force as multiple levels of torque in response to actual working requirements from a curtain system loading end capable of arranging a curtain at different heights, and having dynamic and static friction forces between working pieces of the system, so that the curtain can be folded back and a lower beam can be fixed at any positions.

Figure 1:
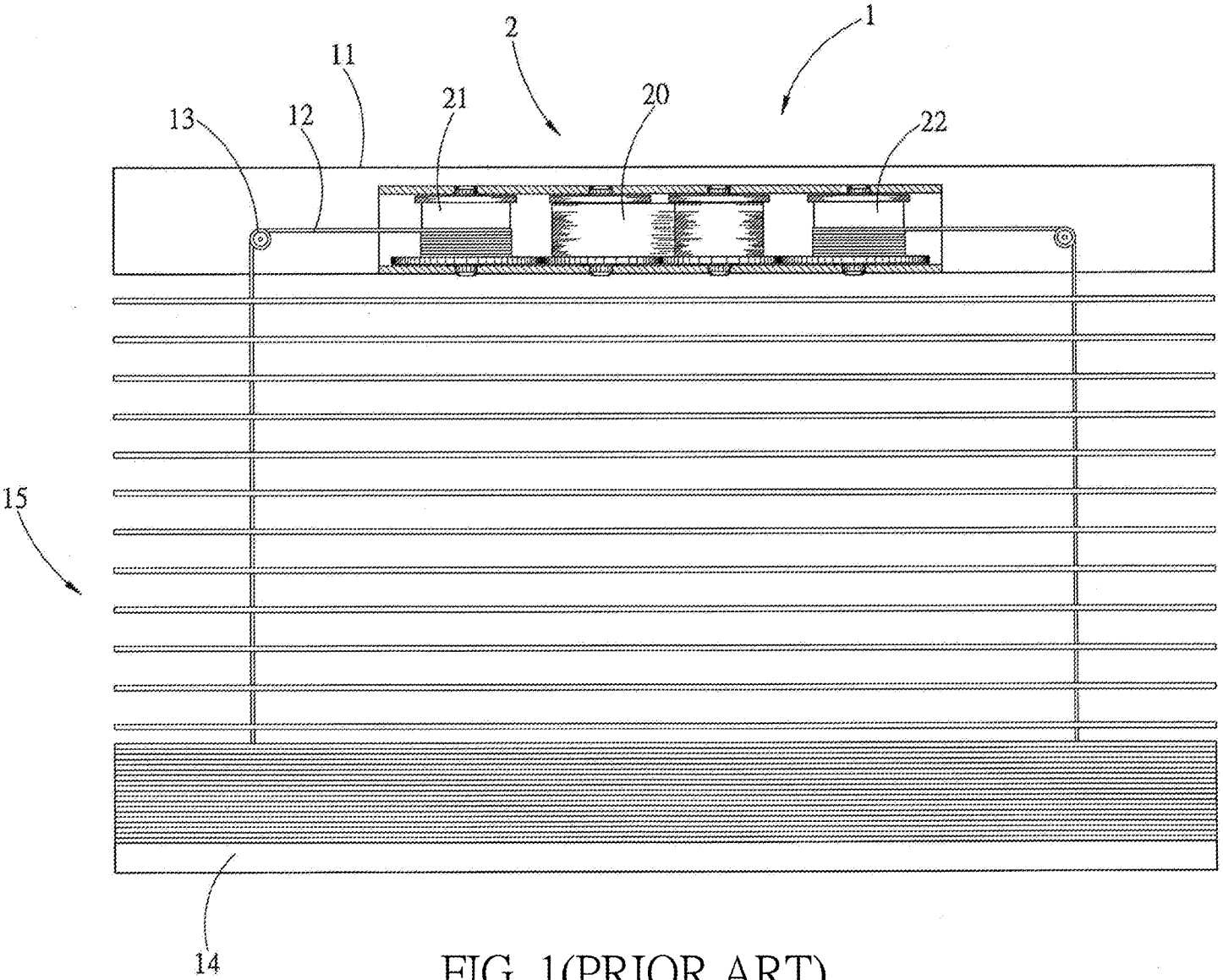
FIG. 1(PRIOR ART)
FIG. 1 is a front structural view of an assembly of a curtain set according to the prior art.
Figure 2:
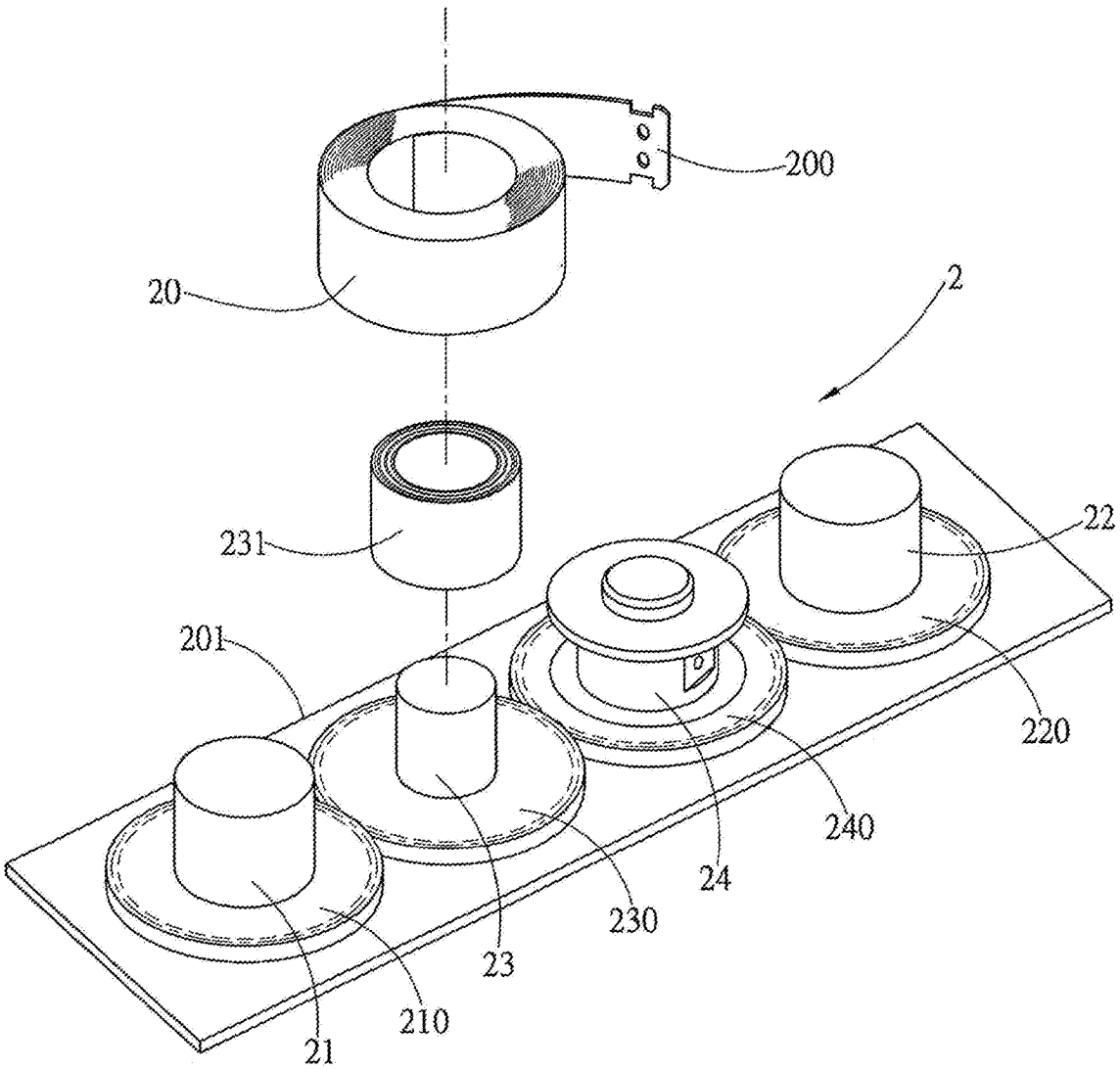
FIG. 2(PRIOR ART)
FIG. 2 is a three-dimensional structural view of a spring motor according to the prior art.
Figure 3:
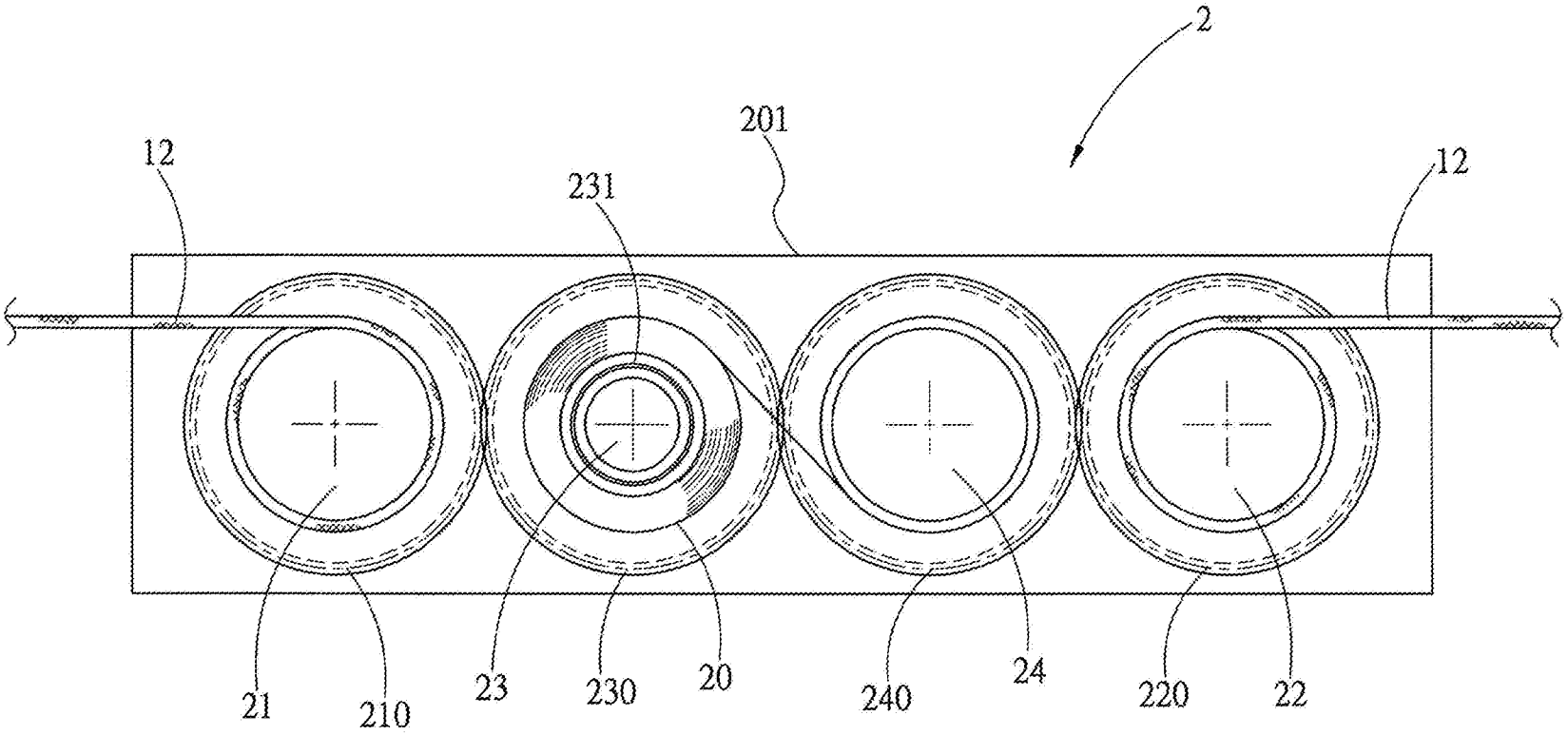
FIG. 3(PRIOR ART)
FIG. 3 is an assembled structural top view of the spring motor according to the prior art.
Figure 4:
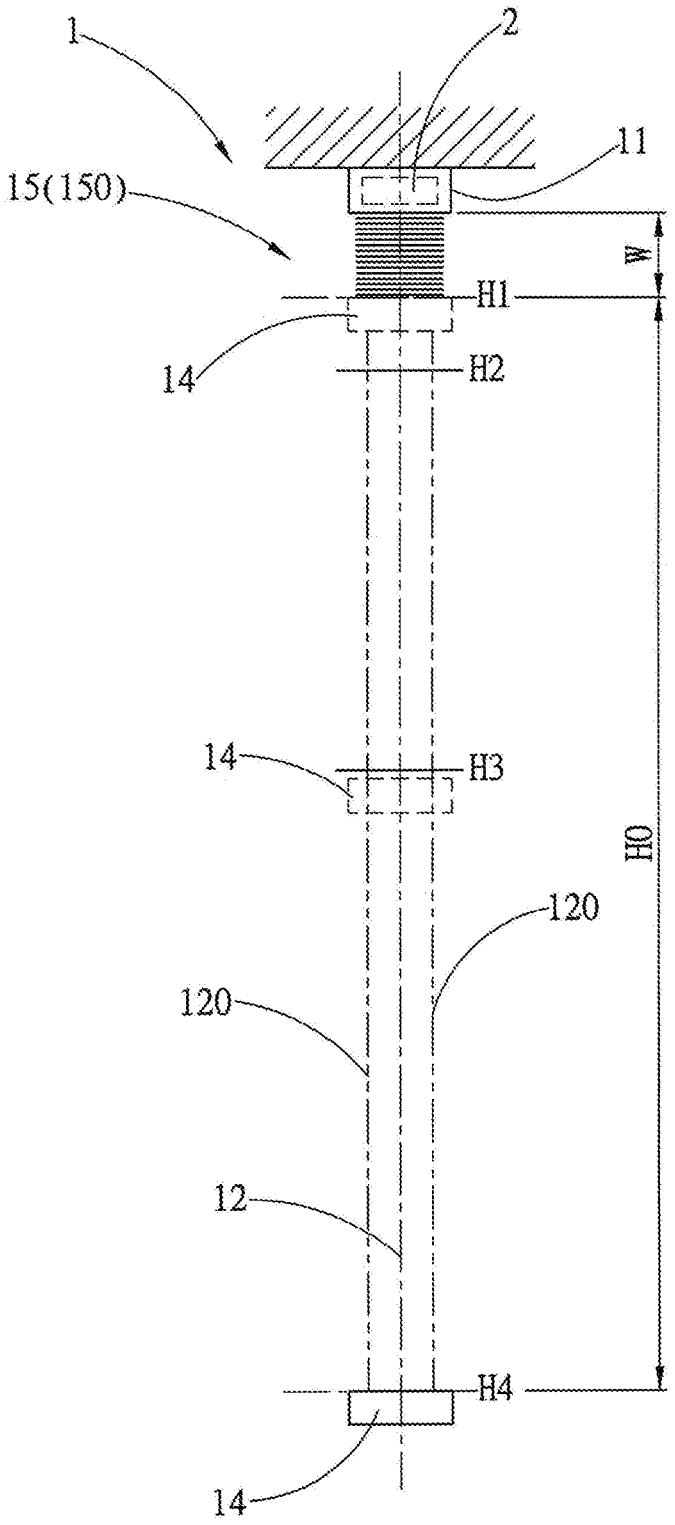
FIG. 4 is a schematic view showing the requirement of force for the curtain-folding process of a curtain set.
Figure 5:
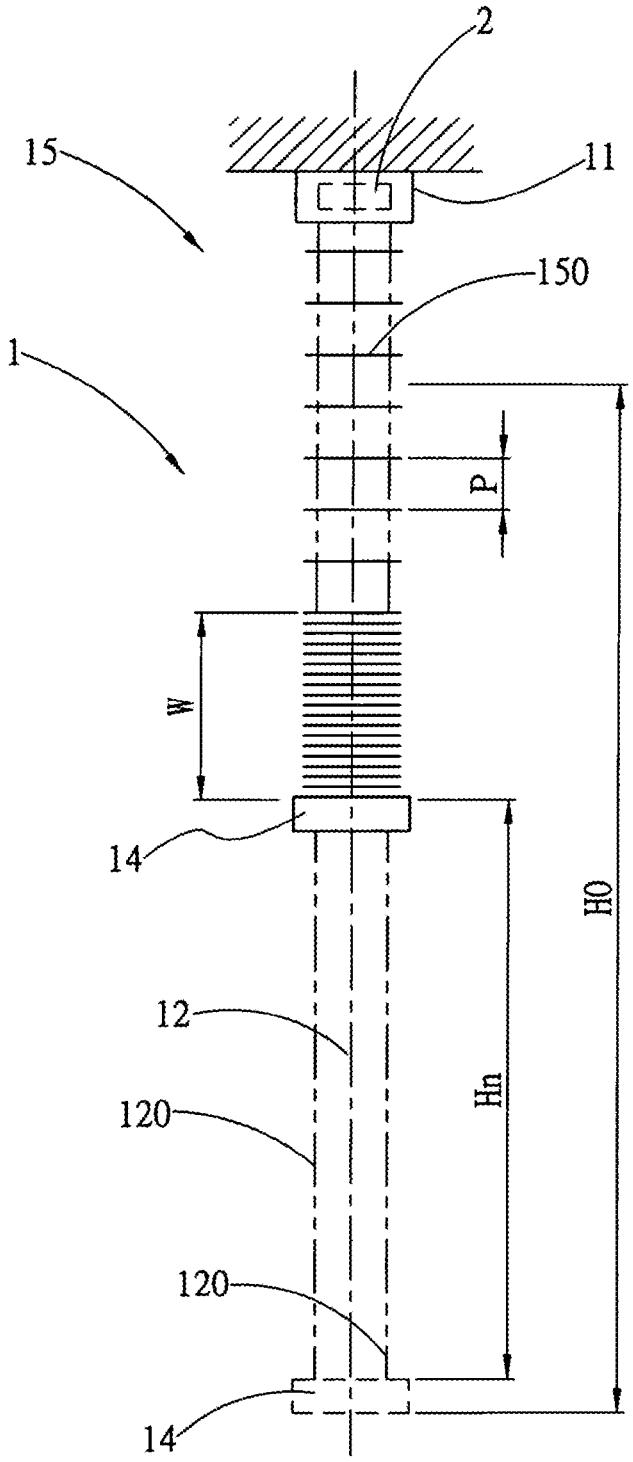
FIG. 5 is a lateral status view showing a lower beam of a curtain set located at the middle of a full lift height.
Figure 6:
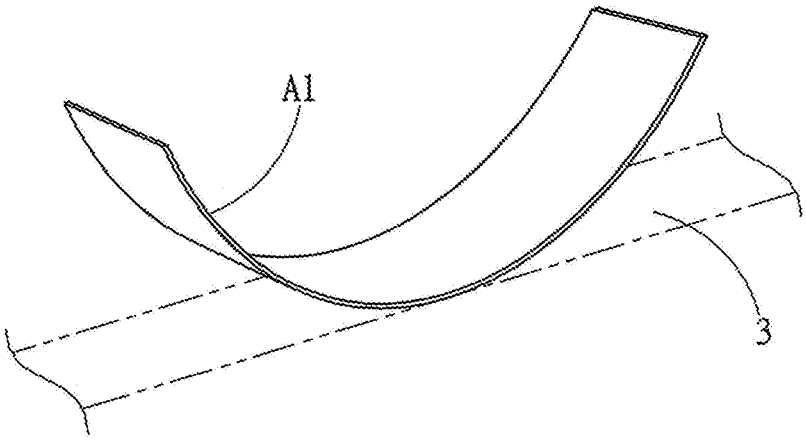
FIG. 6 is a three-dimensional schematic view showing a reed strip of the present disclosure being bent into a first curvature.
Figure 7:
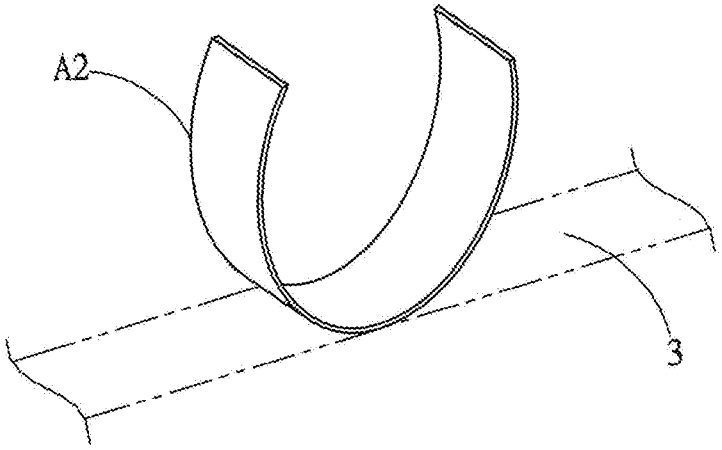
FIG. 7 is a three-dimensional schematic view showing the reed strip of the present disclosure being bent into a second curvature.
Figure 8:
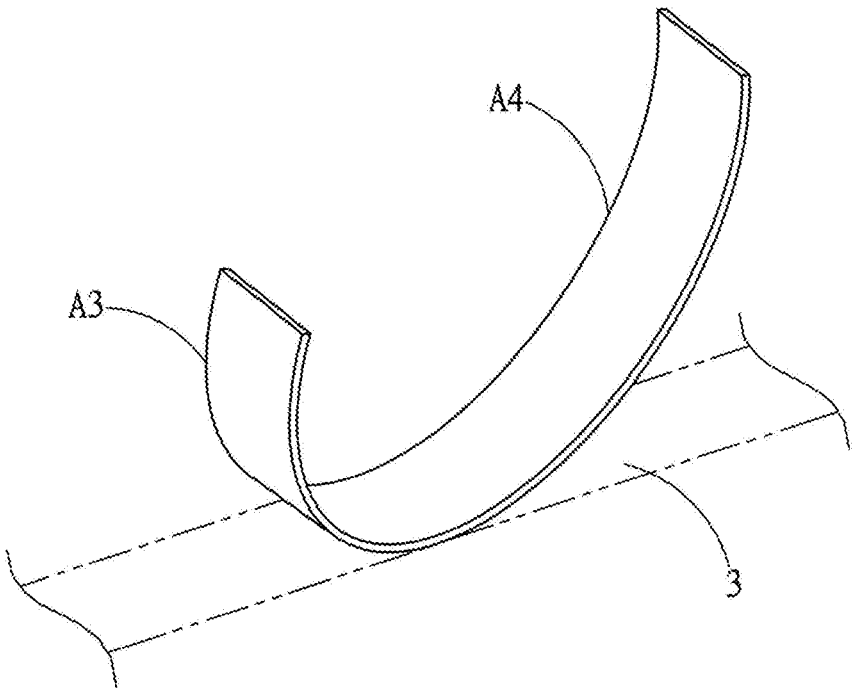
FIG. 8 is a three-dimensional schematic view showing the reed strip of the present disclosure being bent into a third curvature and a fourth curvature.
Figure 9:
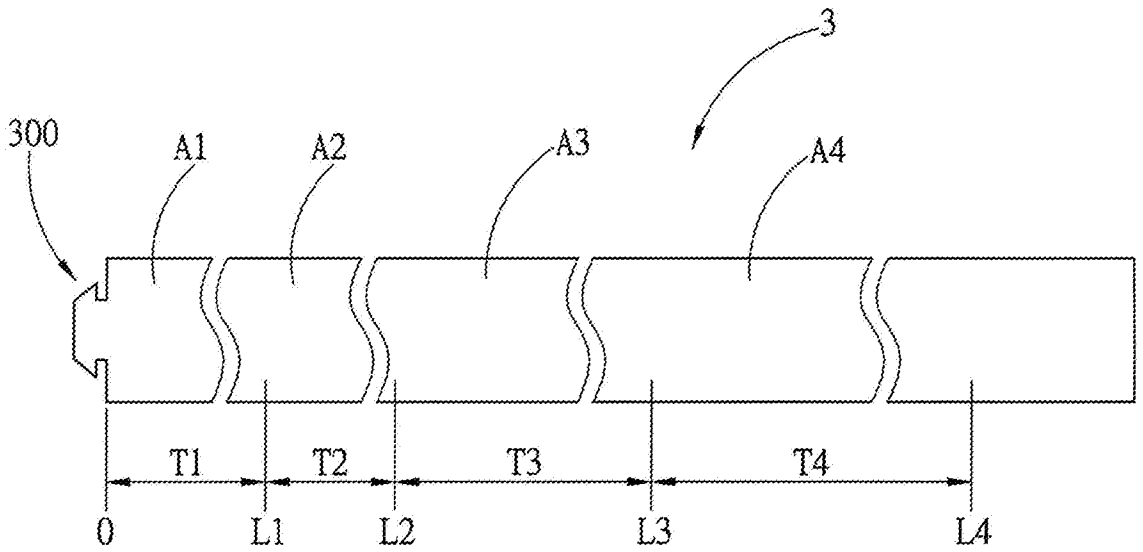
FIG. 9 is a schematic view showing the reed strip of the present disclosure being bent into unequal curvatures at a front end and a rear end.

Referring to FIGS. 6-8 (with reference to FIG. 9), the present disclosure provides a strip of a reed strip 3 having different curvatures disposed as different levels, with an initial curvature A0, a first curvature A1, a second curvature A2, a third curvature A3 and a fourth curvature A4. Each of the unequal curvatures is made by bending the strip toward an identical inner circle. Each of the different curvatures are disposed in the same reed strip 3, and because the electronic spatial structures of different sections of the strip are modified by bending, the resulted elastic reactions of the different sections are different, which gives rise to unequal elastic forces (torque) output from different sections of the strip.

Referring to FIG. 9 again, the reed strip 3 of the present disclosure has an initial curvature A0 disposed in a section starting from a joining end 300 to a first length L1, and a torque generated therefrom is an increasing torque TC that increases suddenly; a first curvature A1 disposed in a section starting from the first length L1 to a second length L2, and the first curvature A1 generates a first torque T1 which is of a slowly increasing arc when viewed on the curvature graph; a second curvature A2 disposed in a section starting from the second length L2 to a third length L3 to form a second torque T2, and the second torque T2 is a constant torque which is of a curve extending from a highest torque output of the first torque T1 when viewed on the curvature graph; a third curvature A3 disposed in a section starting from the third length L3 to a fourth length L4, and the curvature of the third curvature A3 decreases to form a third torque T3; a fourth curvature A4 disposed in a section starting from the fourth length L4 to a fifth length L5, and the curvature of the fourth curvature A4 can be made less to form a smaller fourth torque T4 (points connecting the above-described torque curves are not changed suddenly, but have lines preceding and following the points slowly changing, the description about the points is omitted for the purpose of simplification).

For the purpose of meeting the requirement of forces corresponding to the actual curtain-folding working process, as well as easy fabrication, the reed strip 3 is fabricated by bending several sections separately to allow for the generation of several different torque forces, wherein the second torque T2 is the maximum, and the third torque T3 following the second torque T2 decreases by sloping downwards; the torque forces after the fifth length L5 are not included for consideration.

Figure 10:
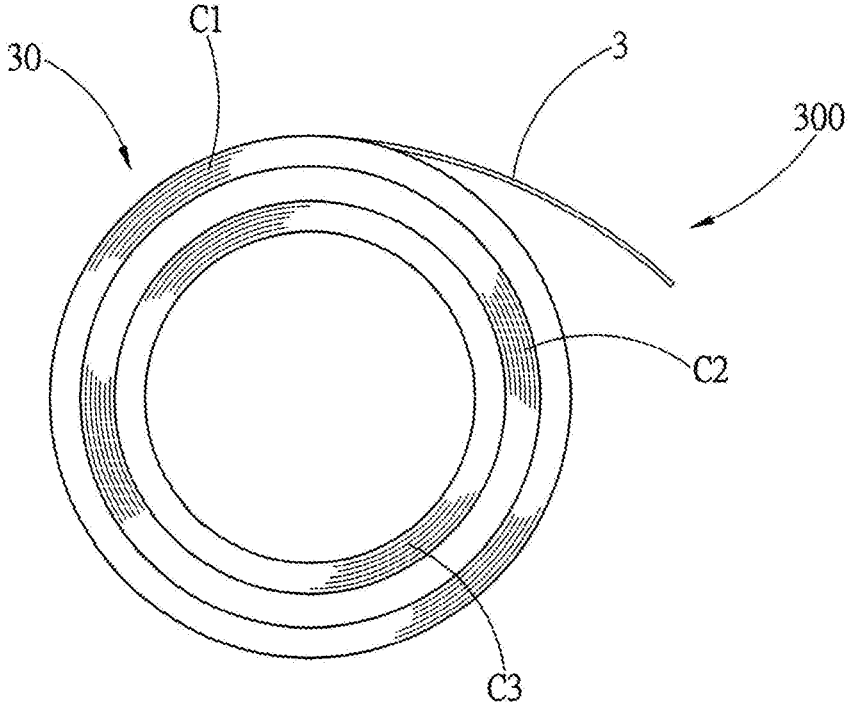
FIG. 10 is a top view of the reed strip of the present disclosure being bent into an unequal-torque coil spring.

Referring to FIG. 10, in which a structure of the formed unequal-torque coil spring 30 can be simplified into 3 layers overall; a curvature of an inner spiral layer C3 gradually becomes less than that of an outer spiral layer C1, and a curvature of a mid spiral layer C2 is also less than that of the outer spiral layer C1. Under a stationary condition, the unequal-torque coil spring 30 can form a self-binding force toward a center thereof to maintain a circular shape.

A ratio between the above-described torque forces, that the ratio of a maximum torque force to a minimum torque force, can be set between 4/1:1/1. The reed strip 3 is formed into an unequal-torque coil spring 30 by coiling, and includes the outer spiral layer C1, the mid spiral layer C2, the inner spiral layer C3 and a joining end 300 disposed at an exposed end of the reed strip 3.

Figure 11:
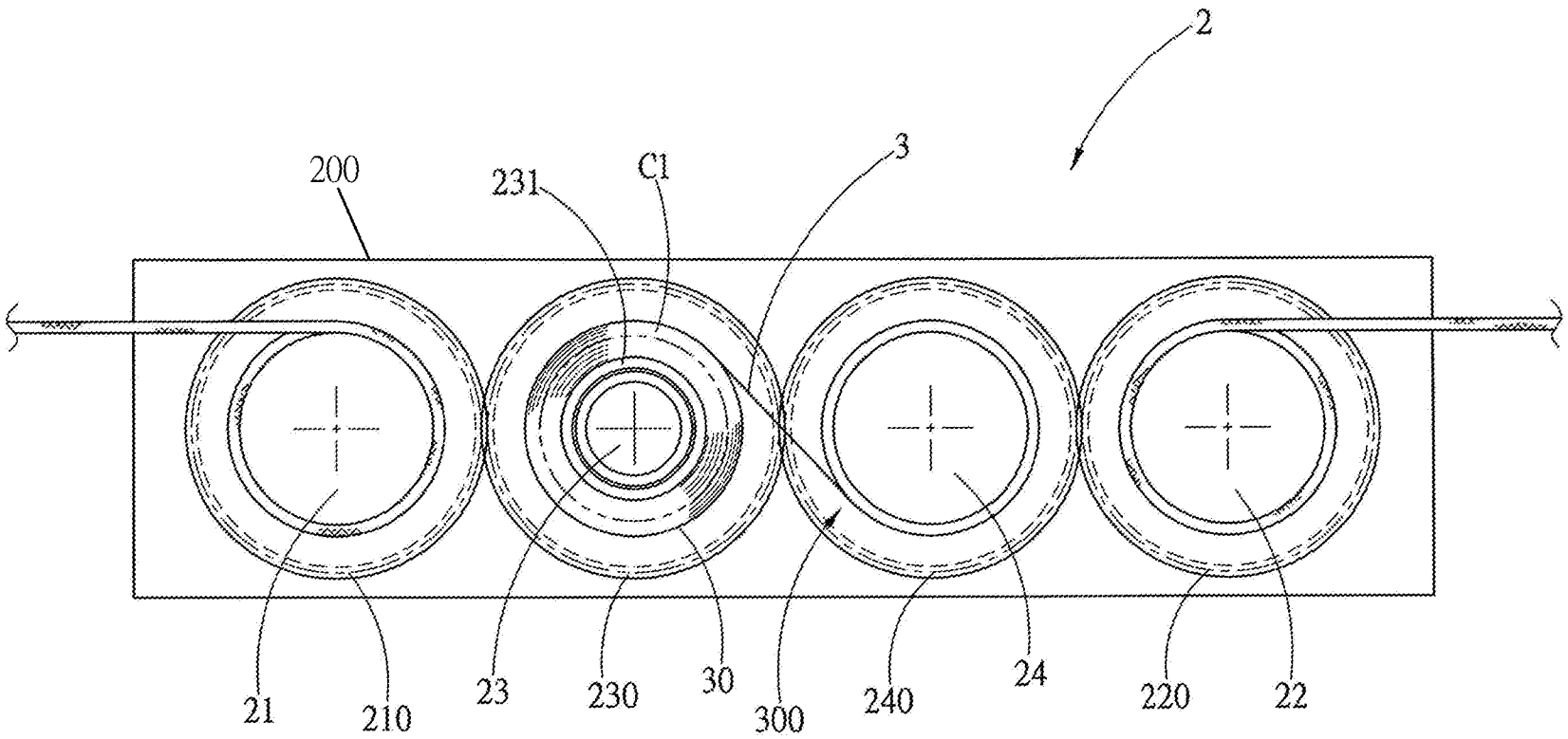
FIG. 11 is a top view of an assembled system where the present disclosure is applied to a spring motor.

Referring to FIG. 11, the unequal-torque coil spring 30 of the present disclosure is implemented in a housing 201 of a spring motor 2, the unequal-torque coil spring 30 is sleeved outside of a cylindrical surface of an axle 23 around an identical center, but is not linked to the axle 23; the joining end 300 disposed at a free end of the reed strip 3 is joined to a cylindrical surface of a coiling axle 24 and linked thereto; an end of the coiling axle 24 is linked to a linking chainring 240, and when driven by a chainring 220 of a second reel drum 22 or a chainring 210 of a first reel drum 21, the linking chainring 240 drives the unequal-torque coil spring 30 to coil toward the direction of the coiling axle 24. Under a stationary condition, the outer spiral layer C1 of the unequal-torque coil spring 30 has the maximum torque and is the first to be coiled into the outer circle of the coiling axle 24; when outputting a feedback torque, the outer spiral layer C1 is the last to be output.

Figure 12:
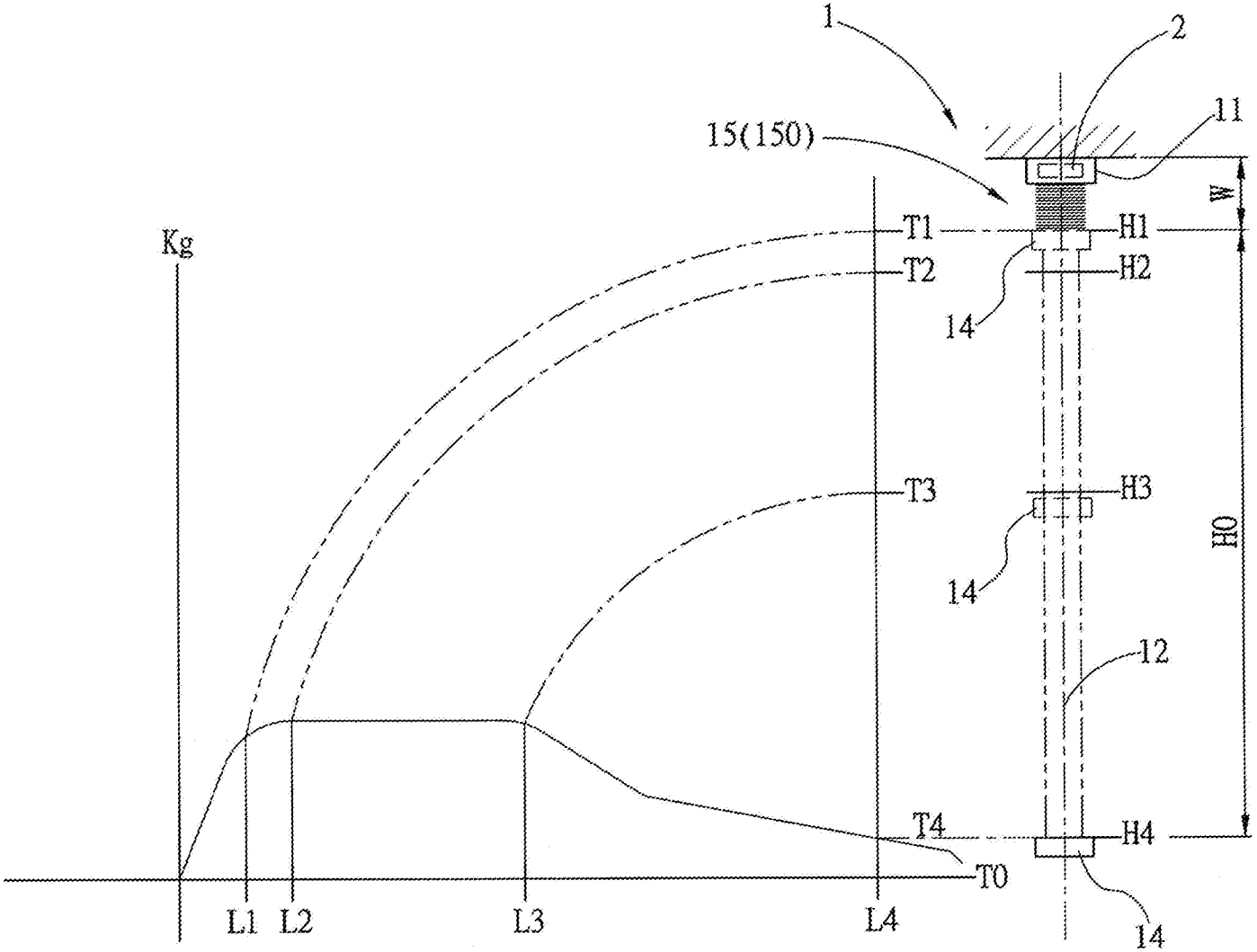
FIG. 12 is a correspondence view of the feedback torque curve of the present disclosure that corresponds to the requirements for the curtain-folding process in a curtain set.

Referring to FIG. 12, the spring motor 2 is applied in a curtain set 1 for folding back a curtain 15. Torque required for curtain-folding is different between a first height H1, a second height H2, a third height H3, a fourth height H4 and a fifth height H5. If a lower beam 14 is folded to a position between the third height H3 and the second height H2, the spring motor 2 withstands a maximum torque that is the second torque T2; the distance between the second height H2 and the first height H1 is the last folding step and is the shortest, and the remaining momentum from the second torque T2 generated for the curtain-folding process is sufficient for uploading a total mass W of the stacked curtain pieces. Therefore, the first torque T1 is only used for pulling and supporting an overall weight resulted from accumulating the total mass W of all stacked curtain pieces 150 and preventing the curtain 15 from falling downward, so the torque of the first torque T1 can be gradually decreased as it approaches the position of the first length L1. In other words, the torque from the first length L1 is able to withstand the total mass W of the stacked curtain pieces.

The second torque T2 generated from the longitudinal section of the reed strip 3 from the second length L2 to the third length L3 is a constant torque that corresponds to the curtain-folding process from the third height H3 to the second height H2 in the curtain set 1; when the curtain 15 is folded upwards, the torque T2 provides the maximum torque for the lower beam 14 to withstand the loading weight of curtain pieces sequentially accumulated on a top surface thereof, and for pulling the lower beam 14 to the second height H2. Subsequently, the first torque T1 is used to return the lower beam 14 to the first height H1. The purpose of having the first torque T1 less than the second torque T2 is to ease a momentum generated from the mass of the curtain 15 and the rising speed before the curtain 15 is folded back to destination (the first height H1), so that a buffering effect can be achieved before the curtain-folding completes, thereby ensuring safe use.

The third torque T3 generated from the section of the reed strip 3 from the third length L3 to the fourth length L4 is a decreasing torque, and the fourth torque T4 generated from the section from the fourth length L4 to the fifth length L5 is less than the third torque T3; the load of the fourth torque T4 is the smallest.

During the folding of curtain, the lower beam 14 is pulled upwards from the fifth height H5 and starts to sequentially accumulate each of the curtain pieces 150 arranged above, and then the third torque T3 takes over as more force is needed for folding when the lower beam 14 reaches the fourth height H4, and the third torque T3 rapidly generates a higher torque to relay the folding process to the second torque T2.

Each of the described levels of torque is able to generate a stopping and fixing force according to any needs when the lower beam 14 is located at any positions within a total lift height H0, so as to prevent the lower beam 14 at a particular height to fall downwards or rise upwards.

In this embodiment, the reed strip 3 corresponds to a measurement of the total lift height H0, and the torque distribution is as follows: the first torque T1 is generated from the section between the first length L1 and the second length L2, the second torque T2 is generated from the section between the second length L2 and the third length L3, the third torque T3 is generated from the section between the third length L3 and the fourth length L4, and the fourth torque T4 is generated from the section between the fourth length L4 and the fifth length L5.

The curve graph shows the second torque T2 as one that needs to withstand a greater torque, and the third torque T3 and the fourth torque T4 can both be decreasing. This method of implementation can achieve a very steady speed for folding the curtain 15. In a most ideal system of mechanics, the most precise curve lines are distributed in a sloping torque curve based on geometric coordinates. But for the purpose of easily manufacturing the unequal-torque coil spring and providing forces required for folding the curtain 15, the torque distribution of the present disclosure is implemented according to the requirements of force for folding the curtain in the curtain set 1.

Figure 13:
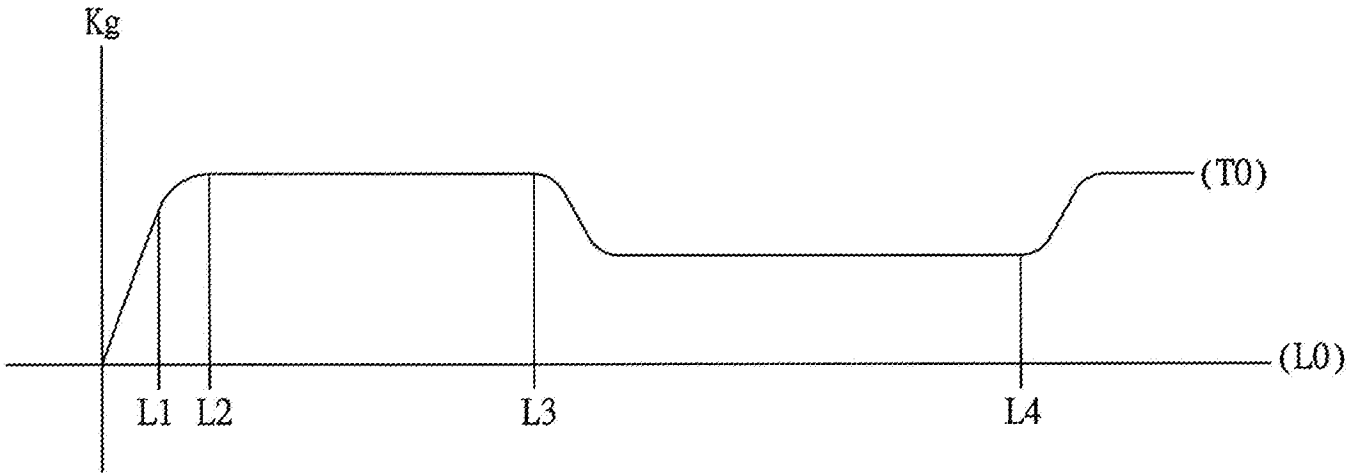
FIG. 13 is another preferred embodiment showing the torque curve implemented by the present disclosure.

In another simple embodiment (refer to FIG. 13 and complemented by FIG. 12), the torque curve T0 of the present disclosure starts from zero and reaches the first length L1 at a great angle of elevation, and achieves a force of 0.5 Kg that is the first torque T1, for instance. The first torque T1 is generated from a level between the first length L1 and the second length L2, and the torque curve of the first torque T1 can be a sloping line or an arc. The second torque T2 generated from the section between the second length L2 and the third length L3 is the maximum constant torque; the third torque T3 generated from the section between the third length L3 and the fourth length L4 decreases at a great downward sloping rate or as an arc; the fourth torque T4 generated from the section between the fourth length L4 and the fifth length L5 is constant.

The above described second torque T2 and fourth torque T4 are both constant, and can satisfy the requirements of force for folding the curtain in the curtain set 1. In the process of fabricating the unequal-torque coil spring, the fabrication process is mainly focused on the second torque T2 and the fourth torque T4, so that the fabrication procedures can be made easier and the making of the torque curve T0 is more convenient.

The present disclosure provides different feedback torque in a reed strip by implementing different curvatures in each of the sections thereof; the distribution of different torque is well suited for providing feedback forces corresponding to different torque requirements of the curtain-folding process in the curtain set 1. Accordingly, a new disclosure is proposed herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An unequal-torque coil spring, wherein feedback torque is provided in response to requirements of unequal forces at a loading end, comprises a long strip of reed strip; the reed strip has different sections longitudinally disposed from a front end to a rear end thereof, and the sections have different curvatures formed by getting coiled and bent inwards to generate different torque; an exposed end serving as a joining end, wherein the reed strip has torque distributed as follows:

an increasing torque is implemented between the joining end and a first length, a first torque that follows the increasing torque and slowly increases is implemented between the first length and a second length, a second torque that follows the first torque and is equal to a maximum value of the first torque is implemented between the second length and a third length, and a third torque that follows the second torque and gradually decreases is implemented between the third length and a fourth length.

2. The unequal-torque coil spring according to claim 1, wherein the unequal-torque coil spring generates usable feedback torque values with a ratio between 4/1:1/1.

3. The unequal-torque coil spring according to claim 1, further comprising a fourth torque following a minimum value of the third torque, wherein the fourth torque gradually decreases and is implemented between the fourth length and a fifth length.

4. The unequal-torque coil spring according to claim 1, further comprising a fourth torque following a minimum value of the third torque, wherein the fourth torque is constant and implemented between the fourth length and a fifth length.

5. A spring motor being applied in a curtain set, which steadily folds a curtain and allows a lower beam to be lowered and fixed at any heights, comprising:

a housing;

a first reel drum and a second reel drum being axially parallel to each other and located at two sides inside of the housing at a same height;

an axle and a coiling axle being axially parallel to each other and located centrally inside the housing at a same height;

a chainring axially linked to an end of the first reel drum;

a chainring axially linked to an end of the second reel drum;

a chainring being axially movable at an end of the axle;

a linking chainring axially linked to an end of the coiling axle;

each of the chainrings and the linking chainring are of a same diameter, and are arranged and engaged from a front end to a rear end;

an unequal-torque coil spring for providing feedback torque in response to requirements of unequal forces at a loading end, comprises a long strip of reed strip; the reed strip has different sections longitudinally disposed from a front end to a rear end thereof, and the sections have different curvatures formed by getting coiled and bent inwards to generate different torque; an exposed end serving as a joining end, wherein the reed strip has torque distributed as follows: an increasing torque is implemented between the joining end and a first length, a first torque that follows the increasing torque and slowly increases is implemented between the first length and a second length, a second torque that follows the first torque and is equal to a maximum value of the first torque is implemented between the second length and a third length, and a third torque that follows the second torque and gradually decreases is implemented between the third length and a fourth length; the unequal-torque coil spring being axially and movably sleeved outside of a cylindrical surface of the axle, the disposed joining end is joined to a radial cylindrical surface of the coiling axle.

6. The spring motor according to claim 5, wherein the unequal-torque coil spring generates usable feedback torque values with a ratio between 4/1:1/1.

7. The spring motor according to claim 5, further comprising a fourth torque following a minimum value of the third torque, wherein the fourth torque gradually decreases and is implemented between the fourth length and a fifth length.

8. The spring motor according to claim 5, further comprising a fourth torque following a minimum value of the third torque, wherein the fourth torque is constant and implemented between the fourth length and a fifth length.

* * * * *